US005893255A

United States Patent [19]

Lee

[11] Patent Number: 5,893,255

[45] Date of Patent: Apr. 13, 1999

[54] METHOD FOR LOCATING A WALL FORM ASSEMBLY ON A FLOOR OF A CONCRETE STRUCTURE, AND IMPLEMENTS FOR USE IN SAID LOCATING METHOD

[76] Inventor: Kou-An Lee, No. 851, Chung-Shan Rd., Nan-Shing Tsun, Kui-Jen Hsiang,Tainan Hsien, Taiwan

[21] Appl. No.: 08/891,466

[22] Filed: Jul. 11, 1997

[51] Int. Cl.[6] ..... E04G 21/14

[52] U.S. Cl. ..... 52/749.13; 52/749.14; 52/745.09; 52/745.1; 52/745.2; 52/DIG. 1; 33/645; 33/533; 33/42

[58] Field of Search ..... 33/645, 533, 42; 52/749.13, 749.14, 745.02, 745.05, 745.09, 745.1, 745.2, 745.21

[56] References Cited

U.S. PATENT DOCUMENTS

| | | | |
|---|---|---|---|
| 2,503,388 | 4/1950 | Hedlund | 414/10 |
| 4,021,979 | 5/1977 | Rez | 52/127 |
| 4,765,771 | 8/1988 | Howsley | 404/74 |
| 5,335,472 | 8/1994 | Phillips | 52/743 |
| 5,544,852 | 8/1996 | Lee . | |
| 5,685,115 | 11/1997 | Coffer | 52/292 |

FOREIGN PATENT DOCUMENTS

| | | | |
|---|---|---|---|
| 651338 | 1/1964 | Belgium | 52/127.2 |
| 406185218 | 7/1994 | Japan . | |
| 6-185218 | 7/1994 | Japan | 52/127.2 |

*Primary Examiner*—Christopher Kent
*Assistant Examiner*—Yvonne Horton-Richardson
*Attorney, Agent, or Firm*—Merchant, Gould, Smith Edell, Welter & Schmidt

[57] ABSTRACT

In a method for locating a wall form assembly at an intended position on a floor of a concrete structure, a number of retaining grooves are initially formed in the floor at a boundary of the intended position of the wall form assembly. Thereafter, a number of upright positioning implements are mounted on the floor in the retaining grooves, respectively, before the wall form assembly is hoisted onto the floor such that an outer side of the wall form assembly abuts against the positioning implements to limit deviation of the wall form assembly from the intended position. A positioning implement and a guiding implement for use in the aforesaid locating method are also disclosed.

8 Claims, 5 Drawing Sheets

METHOD FOR LOCATING A WALL FORM ASSEMBLY ON A FLOOR OF A CONCRETE STRUCTURE, AND IMPLEMENTS FOR USE IN SAID LOCATING METHOD

BACKGROUND OF THE INVENTION

1. Field of the Invention

The invention relates to wall form assemblies, more particularly to a method for locating a wall form assembly at an intended position on a floor of a concrete structure and to implements for use in the aforesaid locating method.

2. Description of the Related Art

A conventional modular wall form assembly, such as that disclosed in U.S. Pat. No. 5,544,852, generally includes a plurality of vertical channel pieces coupled detachably side by side to one another, and a plurality of horizontal reinforcement members mounted detachably on inner sides of the channel pieces. The modular wall form assembly obviates the need to fasten together wood panels when forming concrete partition walls, and is reusable to result in cost benefits when applied in the construction of large structures, such as buildings.

In use, the conventional modular wall form assembly is usually assembled into an appropriate multi-sided configuration before being hoisted to an intended position on a floor of a concrete structure. A partition wall is formed when concrete in a pouring space confined by adjacent wall form assemblies hardens. At present, a lot of time and manpower is spent in checking and correcting the relative positions among the wall form assemblies on the floor of the concrete structure.

Referring to FIG. 1, boundaries 11 are marked on the floor 1 of a concrete structure before a wall form assembly 12 is hoisted onto the floor 1. As the wall form assembly 12 is lowered toward the floor 1, a number of people 13 guide the wall form assembly 12 at corners thereof to align the wall form assembly 12 with the boundaries 11.

Some of the drawbacks of the aforementioned conventional method for locating the wall form assembly 12 on the floor 1 are as follows:

1. Since the people 13 should be on the outer side of the wall form assembly 12 when the latter is aligned with the boundaries 11, the presence of a number of the wall form assemblies 12 on the floor 1 will severely limit the available space for movement of the people 13, thereby making the alignment process difficult to perform.

2. Even in the presence of sufficient space for movement of the people 13 on the floor 1, it is still difficult for the people 13 at the corners of the wall form assembly 12 to align the same with the boundaries 11.

3. A grid of reinforcing steel bars is normally embedded in each concrete partition wall. In the event that a large number of partition walls are to be formed on the floor 1, each grid can only be installed after one of the adjacent wall form assemblies 12, which confine the pouring space for the concrete partition wall, has been positioned on the floor 1 due to the limited size of the pouring space. Therefore, efficiency is adversely affected since installation of the grids or the wall form assemblies 12 cannot be completed at one time. In addition, the presence of the grids further complicates the process of aligning the other wall form assemblies with the respective boundaries.

SUMMARY OF THE INVENTION

Therefore, the main object of the present invention is to provide a method for locating a wall form assembly on a floor of a concrete structure which can overcome the drawbacks commonly associated with the aforementioned prior art.

Another object of the present invention is to provide a positioning implement to be used in limiting deviation of a wall form assembly from an intended position on a floor of a concrete structure when the wall form assembly is hoisted onto the floor.

A further object of the present invention is to provide a guiding implement to facilitate locating of a wall form assembly at an intended position on a floor of a concrete structure in the presence of a grid of reinforcing steel bars that is mounted on the floor adjacent to a boundary of the intended position.

According to one aspect of the present invention, a method for locating a wall form assembly at an intended position on a floor of a concrete structure comprises the steps of:

forming a number of retaining grooves in the floor at a boundary of the intended position of the wall form assembly;

mounting a number of upright positioning implements on the floor in the retaining grooves, respectively; and hoisting the wall form assembly onto the floor such that an outer side of the wall form assembly abuts against the positioning implements to limit deviation of the wall form assembly from the intended position on the floor.

According to another aspect of the present invention, a positioning implement is adapted to be mounted in a retaining groove that is formed in a floor of a concrete structure at a boundary of an intended position of a wall form assembly on the floor so as to limit deviation of the wall form assembly from the intended position when the wall form assembly is hoisted onto the floor. The positioning implement comprises:

a vertical shaft having a bottom portion with a front side and opposite lateral sides;

a positioning seat mounted on the front side of the bottom portion of the shaft, the positioning seat having a bottom edge portion; and a pair of support wings mounted respectively on the opposite lateral sides of the bottom portion of the shaft, the support wings having bottom edges which are raised with respect to the bottom edge portion of the positioning seat, the bottom edge portion of the positioning seat being adapted to be inserted into the retaining groove such that the bottom edges of the support wings abut firmly against the floor.

According to a further aspect of the present invention, a guiding implement is adapted to be installed on a grid of reinforcing steel bars which is mounted on a floor of a concrete structure adjacent to a boundary of an intended position of a wall form assembly on the floor and which is provided with a fixture. The guiding implement is adapted to protect the fixture while the wall form assembly is being lowered onto the floor, and comprises:

an elongated vertical plate having a top guide portion that extends rearwardly and upwardly, and a rear side that is mounted with a hook unit which is adapted to secure removably the vertical plate on the grid.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

In the method of the present invention, retaining grooves are formed in the floor of a concrete structure after boundaries corresponding to the intended positions of a number of wall form assemblies have been marked on the floor. The retaining grooves serve as references for locating the wall form assemblies on the floor in a precise manner.

Figure 1:
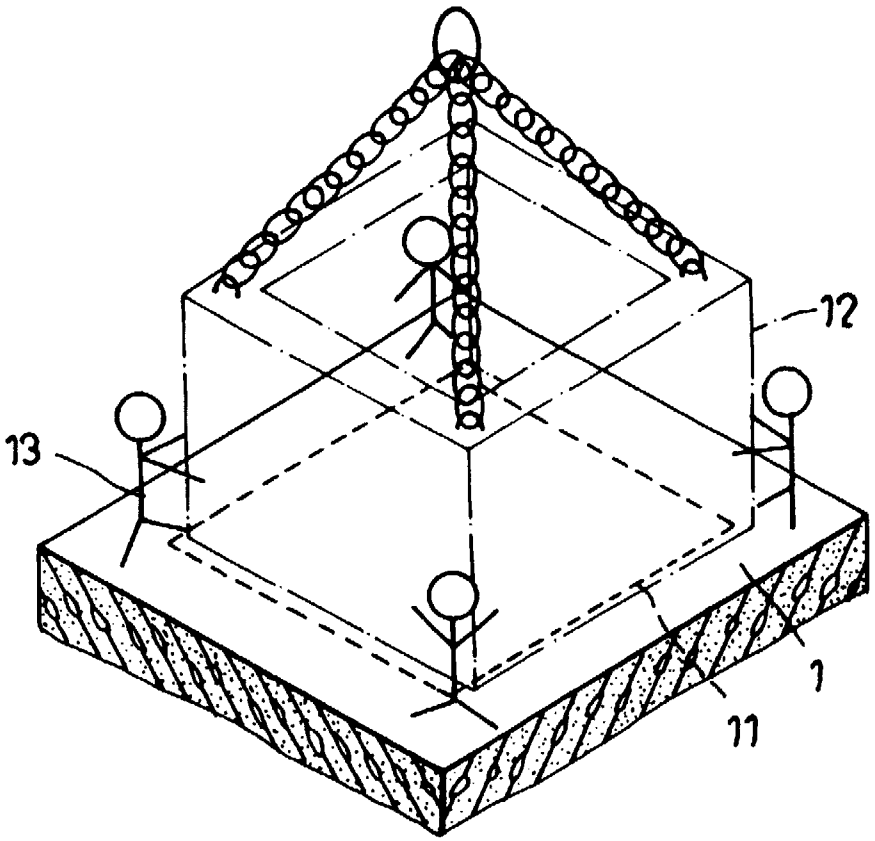
FIG. 1 PRIOR ART
FIG. 1 illustrates how a wall form assembly is located at an intended position on a floor of a concrete structure in a conventional manner.
Figure 2:
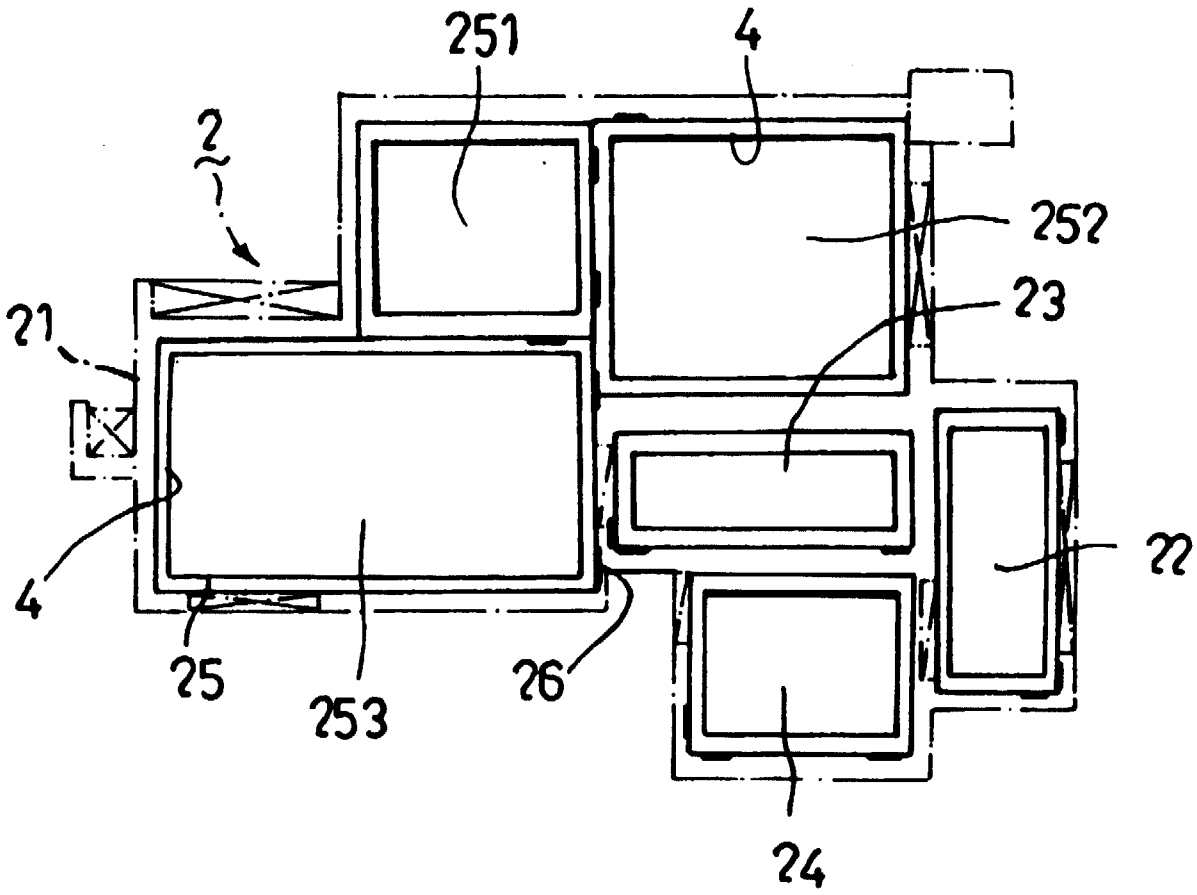
FIG. 2 is a floor layout which illustrates the locations of retaining grooves to be formed in a floor of a concrete structure according to the preferred embodiment of a locating method of this invention.

As shown in FIG. 2, four rooms 22, 23, 24, 25, which are confined by partition walls 21, are to be formed on a floor 2. Note that the rooms 22, 23, 24, 25 have different shapes and sizes. For the smaller rooms 22, 23, 24 that have regular shapes, only one wall form assembly 4 is needed to form the partition walls 21 therefor. The larger room 25, which has an irregular shape, can be divided into several regular-shaped sub-rooms 251, 252, 253 such that a wall form assembly 4 can be disposed in each of the sub-rooms 251, 252, 253. However, since no partition walls 21 are to be formed within the larger room 25, the wall form assemblies 4 in the sub-rooms 251, 252, 253 abut against each other as there is no need to form concrete pouring spaces thereamong.

Preferably, three retaining grooves 26 are formed in the floor 2 at the boundary of the intended position for each of the wall form assemblies 4. Two of the retaining grooves 26 are to be disposed adjacent to opposite ends of a first outer side of the corresponding wall form assembly 4. The third retaining groove 26 is to be disposed adjacent to one end of a second outer side of the corresponding wall form assembly 4, the second outer side being adjacent to the first outer side.

Normally, one of the longer sides of the wall form assembly 4 is chosen as the first side, while one of the shorter sides of the same is chosen as the second side. However, during actual use, it is also important to consider the hoisting sequence of the wall form assemblies 4 and the relative positions of adjacent sub-rooms, a sub-room and an adjacent room, or adjacent rooms. In the example of FIG. 2, it is more appropriate to locate two of the retaining grooves 26 on the right shorter side of the wall form assembly 4 in the sub-room 253 since the sub-room 253 is adjacent to the sub-room 252 and the smaller room 23.

Figure 3:
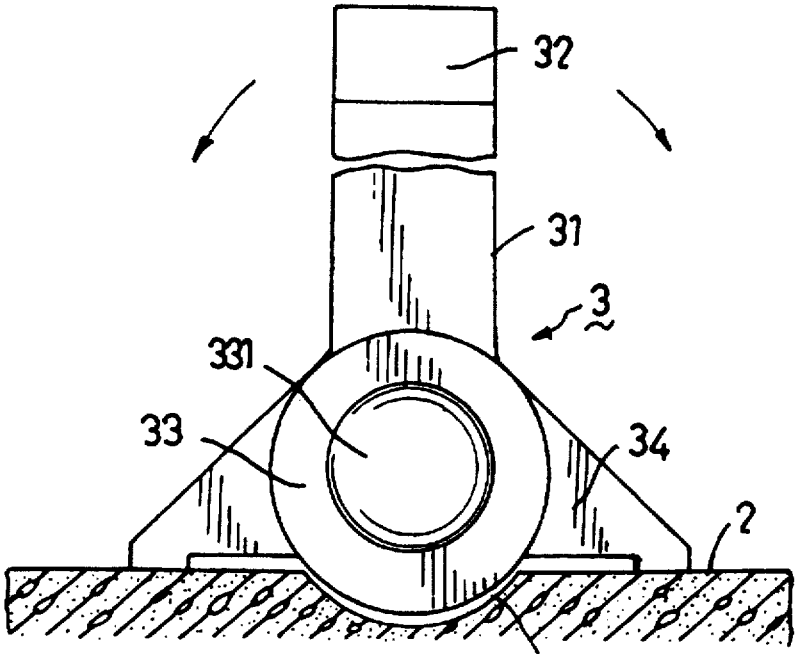
FIG. 3 is a front view of the preferred embodiment of a positioning implement according to the present invention.
Figure 4:
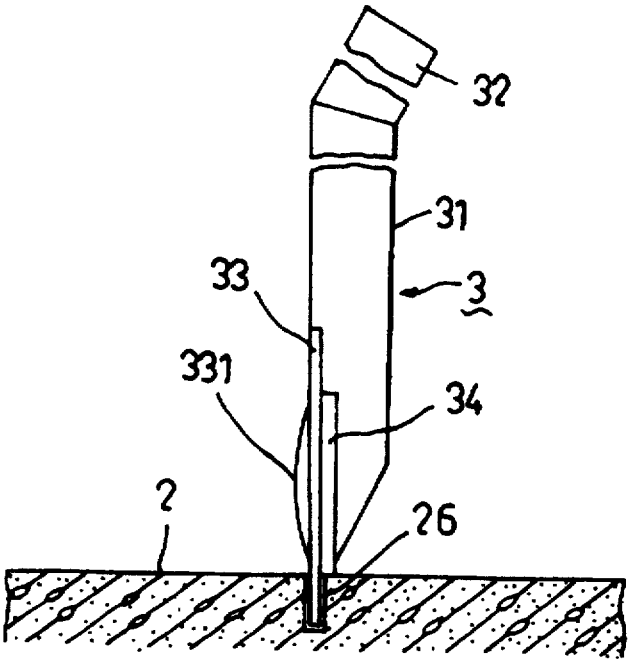
FIG. 4 is a side view of the positioning implement shown in FIG. 3.

Upright positioning implements are mounted on the floor 2 after the retaining grooves 26 corresponding to the rooms 22, 23, 24 and the sub-rooms 251, 252, 253 have been formed. Referring to FIGS. 3 and 4, each positioning implement 3 includes a vertical shaft 31 which is formed from a tube with a rectangular cross-section and which has a length that corresponds to the height of the wall form assembly. The shaft 31 has a top guide portion 32 which inclines rearwardly and upwardly, and a bottom portion with a front side and opposite lateral sides. A positioning seat 33, which is formed as a circular plate, is mounted on the front side of the bottom portion of the shaft 31. The positioning seat 33 has a front side formed with a rounded protuberance 331 at a central portion thereof, and a bottom edge portion. A pair of support wings 34 are mounted respectively on the opposite lateral sides of the bottom portion of the shaft 31. The support wings 34 have bottom edges which are raised with respect to the bottom edge portion of the positioning seat 33. The bottom edge portion of the positioning seat 33 is to be inserted into a respective one of the retaining grooves 26 in the floor 2 such that the bottom edges of the support wings 34 abut firmly against the floor 2. When removing the positioning implement 3 from the floor 2, the positioning implement 3 is simply rocked to-and-fro in the direction of the support wings 34 to pull the positioning seat 33 away from the retaining groove 26.

Figure 5:
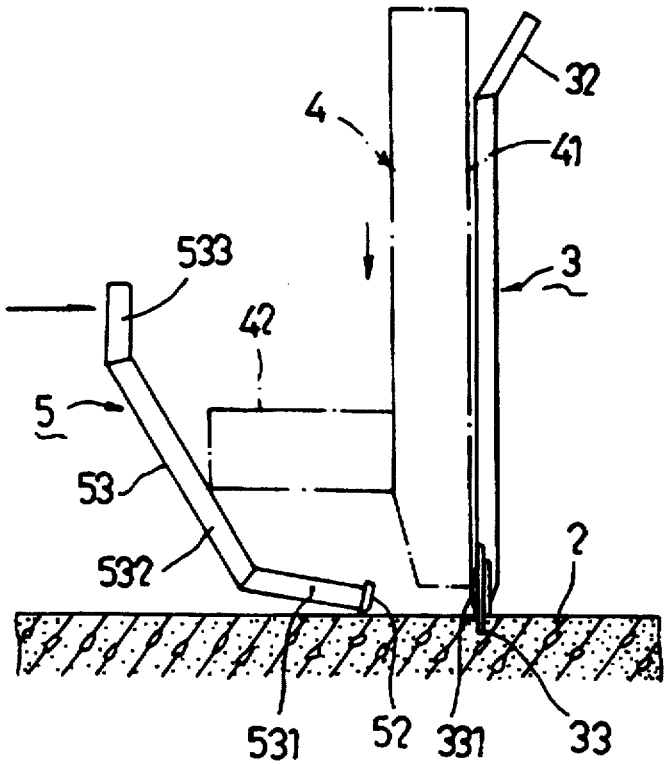
FIG. 5 is a schematic view illustrating how a wall form assembly is located at the intended position with the use of the positioning implement of FIG. 3 and a pushing implement in accordance with the preferred embodiment.
Figure 6:
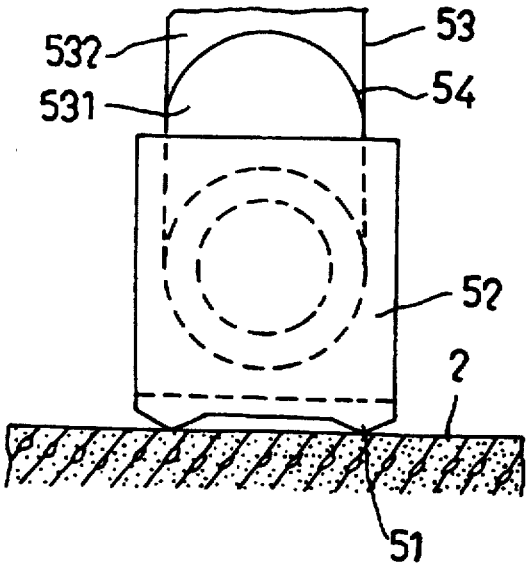
FIG. 6 is an enlarged front view of a lower portion of the pushing implement shown in FIG. 5.

The wall form assemblies 4 are hoisted onto the floor 2 once the positioning implements 3 have been mounted on the floor 2. As shown in FIG. 5, the wall form assembly 4 may have a modular configuration which includes vertical channel pieces 41 that are coupled detachably side by side to one another, and horizontal reinforcement members 42 that are mounted detachably on inner sides of the channel pieces 41. As the wall form assembly 4 is lowered onto the floor 2, the bottom edges of the channel pieces 41 are guided by the top guide portions 32 of the shafts 31 to align the wall form assembly 4 with the intended position on the floor 2. As such, the positioning implements 3 limit deviation of the wall form assembly 4 from the intended position on the floor 2 while the wall form assembly 4 is being lowered onto the floor 2.

As the bottom edges of the channel pieces 41 approach the positioning seats 33 of the positioning implements 3, people inside the wall form assembly 4 can be equipped with a pushing implement 5 to facilitate pushing of the wall form assembly 4 toward the positioning implements 3. The pushing implement 5 includes an upright shank 53 and a seat 52 mounted on the shank 53. The shank 53 includes an inclined lower section 531 with upper and lower ends, an inclined upper section 532 having an upper end and a lower end connected to the upper end of the inclined lower section 531, and a grip section 533 which extends vertically from the upper end of the inclined upper section 532. The inclined upper section 532 is steeper than the inclined lower section 531. In this embodiment, the lower end of the inclined upper section 532 is welded to the upper end of the inclined lower section 531, thereby forming a weld line 54. The seat 52 is mounted on the lower end of the inclined lower section 531 and is formed as a rectangular upright plate with a bottom edge that is provided with claws 51.

In use, the inclined lower section 531 is extended below a lowermost one of the reinforcement members 42 of the wall form assembly 4 so that the claws 51 scrape the floor 2 and so that the inclined upper section 532 abuts against one side of the reinforcement member 42. Thus, the pushing implement 5 can serve as a lever to facilitate pushing of the wall form assembly 4 to abut against the protuberances 331 of the positioning implements 3 in order to locate the wall form assembly 4 at the intended position on the floor 2.

Figure 7:
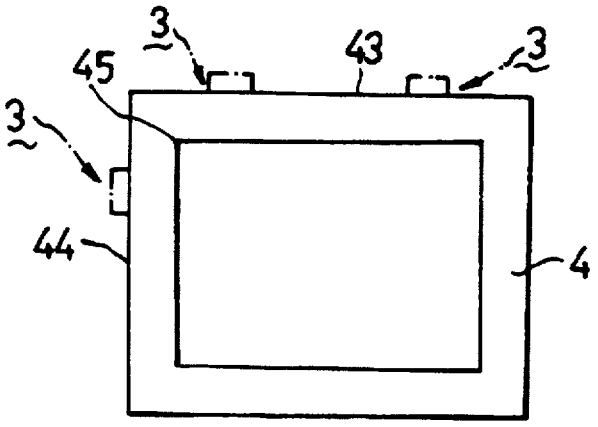
FIG. 7 is a schematic view illustrating how the pushing implement is used to push a wall form assembly toward the positioning implements in accordance with the preferred embodiment.

Referring to FIG. 7, the wall form assembly 4 is shown to have a longer side 43 that abuts against two of the positioning implements 3, and a shorter side 44 that abuts against the third positioning implement 3. The pushing implement 5 can be applied at a corner 45 defined by the longer and shorter sides 43, 44 to force the outer side of the wall form assembly 4 to abut against the three positioning implements 3.

Note that the pushing implement 5 is not essential in the method of the present invention. Without the pushing implement 5, the wall form assembly 4 can still be forced, albeit manually, against the positioning implements 3.

Figure 8:
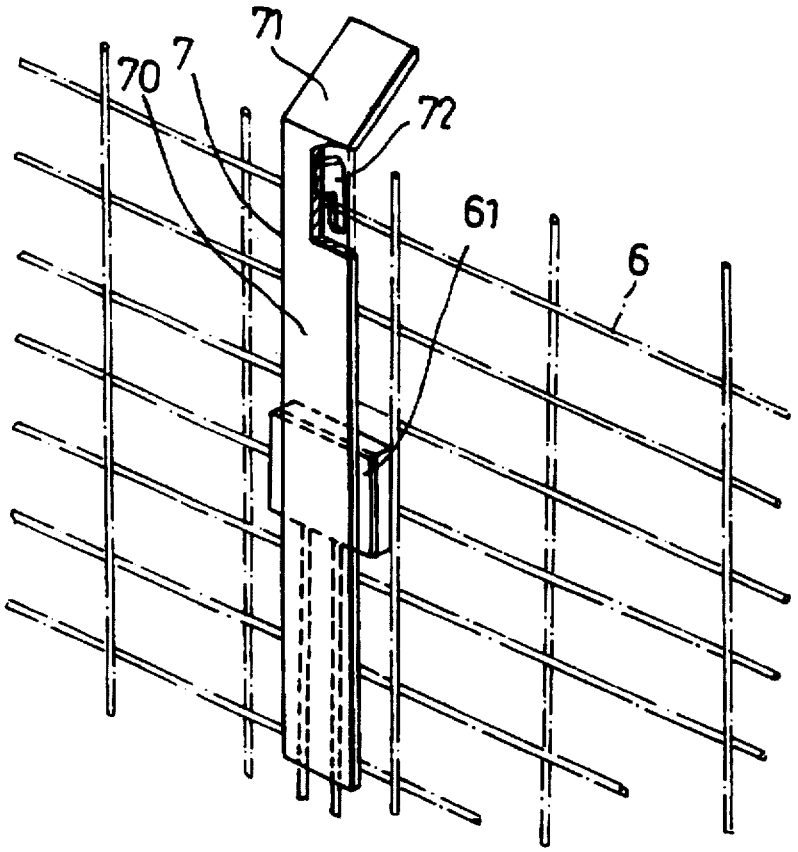
FIG. 8 is a perspective view illustrating the preferred embodiment of a guiding implement of this invention when installed on a grid of reinforcing steel bars.

Referring to FIG. 8, in the method of the present invention, a grid 6 of reinforcing steel bars can be mounted on the floor of the concrete structure adjacent to the boundary of the intended position of the wall form assembly (not shown) before the latter is hoisted onto the floor. As illustrated, fixtures 61 (only one is shown), such as electrical sockets, plumbing fixtures or gas pipe fixtures, are generally provided on the grid 6 so as to be embedded in the concrete partition wall that is to be formed. In the preferred embodiment, a guiding implement 7 is installed on the grid 6 in order to protect a corresponding fixture 61 while the wall form assembly is being lowered onto the floor. The guiding implement 7 comprises an elongated vertical plate 70 having a length which corresponds to the height of the wall form assembly and a width which is sufficient so as to conceal the corresponding fixture 61 on the grid 6. The vertical plate 70 has a top guide portion 71 that extends rearwardly and upwardly, and a rear side that is mounted with a hook unit 72 for securing removably the vertical plate 70 on the grid 6.

Since people operate within the wall form assembly when the latter is positioned in accordance with the method of the present invention, the presence of a number of the wall form assemblies on the floor will not limit the movement of the people, thereby making the alignment process easier to conduct. Also, since the lengths of the positioning implements and the guiding implements correspond to the height of the wall form assembly, the persons in the wall form assembly can reach behind the latter to remove the positioning implements and the guiding implements once the wall form assembly has been properly positioned. Moreover, the grids of reinforcing steel bars may be installed before or after the wall form assemblies have been located at the intended positions on the floor to result in increased efficiency. In addition, use of the pushing implements facilitates pushing of the wall form assembly toward the positioning implements in order to locate the wall form assembly at the intended position in a precise manner. Furthermore, the use of the guiding implements facilitates positioning of the wall form assembly at the intended position on the floor even in the presence of the grids of reinforcing steel bars. The objects of the present invention are thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A method for locating a wall form assembly at an intended position on a floor of a concrete structure, comprising the steps of:

forming a number of retaining grooves in the floor at a boundary of the intended position of the wall form assembly;

mounting a number of upright positioning implements on the floor in the retaining grooves, respectively; and hoisting the wall form assembly onto the floor such that an outer side of the wall form assembly abuts against the positioning implements to limit deviation of the wall form assembly from the intended position on the floor.

2. The method of claim 1, further comprising the step of using a pushing implement to push the wall form assembly toward the positioning implements as the wall form assembly is lowered onto the floor.

3. The method of claim 1, further comprising the step of mounting a grid of reinforcing steel bars adjacent to the boundary of the intended position of the wall form assembly prior to hoisting of the wall form assembly onto the floor, the grid being provided with a fixture thereon.

4. The method of claim 3, further comprising the step of installing a guiding implement on the grid to protect the fixture while the wall form assembly is being lowered onto the floor.

5. A positioning implement adapted to be mounted in a retaining groove that is formed in a floor of a concrete structure at a boundary of an intended position of a wall form assembly on the floor so as to limit deviation of the wall form assembly from the intended position when the wall form assembly is hoisted onto the floor, said positioning implement comprising:

a vertical shaft having a bottom portion with a front side and opposite lateral sides;

a positioning seat mounted on said front side of said bottom portion of said shaft, said positioning seat having a bottom edge portion; and a pair of support wings mounted respectively on said opposite lateral sides of said bottom portion of said shaft, said support wings having bottom edges which are raised with respect to said bottom edge portion of said positioning seat, said bottom edge portion of said positioning seat being adapted to be inserted into the retaining groove such that said bottom edges of said support wings abut firmly against the floor.

6. The positioning implement of claim 5, wherein said shaft has a top guide portion which inclines rearwardly and upwardly.

7. The positioning implement of claim 5, wherein said positioning seat is formed as a circular plate and has a front side with a central portion which is formed with a rounded protuberance that is adapted to abut against the wall form assembly when the wall form assembly is located at the intended position on the floor.

8. A guiding implement adapted to be installed on a grid of reinforcing steel bars which is mounted on a floor of a concrete structure adjacent to a boundary of an intended position of a wall form assembly on the floor and which is provided with a fixture, said guiding implement being adapted to protect the fixture while the wall form assembly is being lowered onto the floor, said guiding implement comprising:

an elongated vertical plate having a top guide portion that extends rearwardly and upwardly, and a rear side that is mounted with a hook unit which is adapted to secure removably said vertical plate on the grid.

* * * * *